US005742868A

United States Patent [19]

Rushing

[11] Patent Number: 5,742,868

[45] Date of Patent: Apr. 21, 1998

[54] METHOD AND APPARATUS OF ADJUSTING OF CHARGE LEVEL ON AN ELECTORSTATOGRAPHIC RECORDING MEDIUM

[75] Inventor: Allen Joseph Rushing, Webster, N.Y.

[73] Assignee: Eastman Kodak Company, Rochester, N.Y.

[21] Appl. No.: 661,527

[22] Filed: Jun. 11, 1996

[51] Int. Cl.[6] ..... G03G 15/045

[52] U.S. Cl. ..... 399/50; 399/48

[58] Field of Search ..... 399/50, 48, 168

[56] References Cited

U.S. PATENT DOCUMENTS

| | | | |
|---|---|---|---|
| 4,105,321 | 8/1978 | Urso | 399/50 |
| 4,248,519 | 2/1981 | Urso | 399/50 |
| 4,355,885 | 10/1982 | Nagashima | 399/50 |
| 4,724,461 | 2/1988 | Rushing | 399/50 |
| 4,928,142 | 5/1990 | Kloosterman . | |
| 4,939,544 | 7/1990 | Cain . | |
| 5,426,487 | 6/1995 | Stelter et al. | 399/50 |
| 5,523,831 | 6/1996 | Rushing | 399/50 |

*Primary Examiner*—R. L. Moses
*Attorney, Agent, or Firm*—Norman Rushefsky

[57] ABSTRACT

A method and apparatus of producing images includes a primary charger for depositing a primary electrostatic charge on an electrostatographic recording member. A first electrometer measures or senses the primary electrostatic charge. A light source such as an EL panel is enabled to reduce the level of the primary electrostatic charge to provide a reduced voltage level suited for recording on the image frame. The reduced voltage level on the image frame is imagewise modulated to form an electrostatic image. The electrostatic image is then developed with toner. The output of the EL panel is adjusted in response to a first factor related to a measured value of the level of the primary electrostatic charge and a set point value for the level of the reduced voltage level and a second factor related to error in the level of the reduced voltage level from the set point value for the reduced voltage level. In a specific embodiment of a DAD-CAD process, the primary charge on the image frame is imagewise modulated by a first ROS device and developed with a DAD development station. Thereafter, the image frame with the reduced charge level is imagewise modulated by a second ROS device and developed by a CAD development station.

15 Claims, 5 Drawing Sheets

10
POWER SUPPLY
16
FROM LCU
TO 15
TO 9
TO 7
TO 11
TO LCU
LCU
100
TO M
TO 16
TO 12
WRITER CONTROLLER
24
TO 5
DATA SOURCE
30
14
5
V0
EM1
9
29
1
2
4
40
25
32
FROM 16
38
36
23
19
T
22
S
21
A
27
FROM LCU
15
FROM 16
17
34
32
12
26
FROM LCU
EL
M
FROM LCU
30
DAD
7
EM2
TO LCU
FROM LCU
29
V0'
11
CAD
++
+++

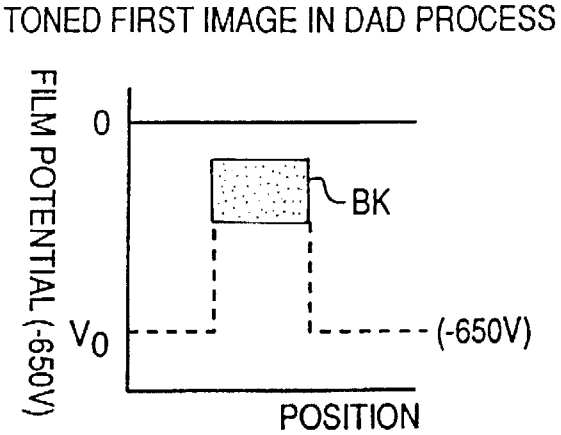
FIG. 2A
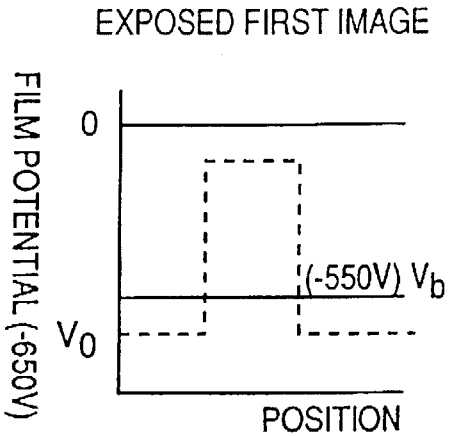
FIG. 2B
FIG. 2C
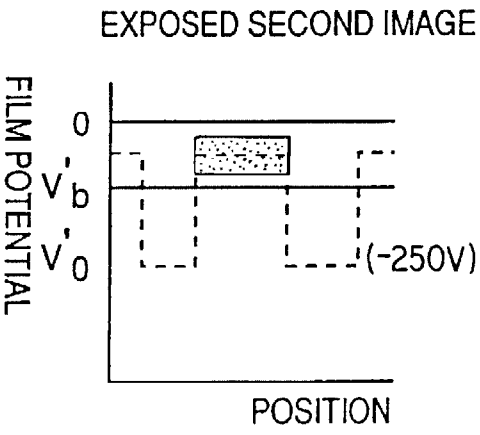
FIG. 2D
FIG. 2E
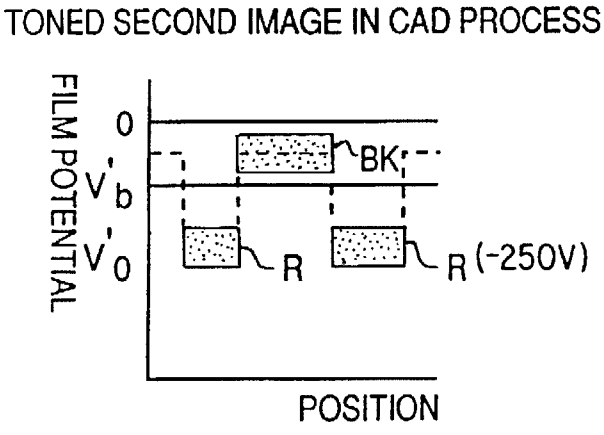
FIG. 2F

| $V_O / V'_O$ SET POINT | 350 | 375 | 400 | 425 | 450 | 475 |
|---|---|---|---|---|---|---|
| | | | | | | |
| 400 | 1.3 | 0.65 | | | | |
| 425 | 1.95 | 1.33 | 0.62 | | | |
| 450 | 2.60 | 1.98 | 1.28 | 0.624 | | |
| 475 | 3.16 | 2.58 | 1.91 | 1.34 | 0.67 | |
| 500 | 3.82 | 3.21 | 2.63 | 1.99 | 1.32 | 0.654 |
| 525 | 4.34 | 3.79 | 3.19 | 2.63 | 1.95 | 1.3 |
| 550 | 4.91 | 4.32 | 3.78 | 3.17 | 2.60 | 1.99 |
| 575 | 5.46 | 4.89 | 4.27 | 3.69 | 3.10 | 2.52 |
| 600 | 5.99 | 5.39 | 4.82 | 4.22 | 3.67 | 3.12 |
| 625 | 6.49 | 5.92 | 5.33 | 4.72 | 4.21 | 3.60 |
| 650 | 7.10 | 6.43 | 5.80 | 5.27 | 4.72 | 4.16 |
| 675 | 7.6 | 6.89 | 6.36 | 5.78 | 5.21 | 4.65 |
| 700 | 8.2 | 7.43 | 6.86 | 6.23 | 5.64 | 5.13 |

FIG. 5

METHOD AND APPARATUS OF ADJUSTING OF CHARGE LEVEL ON AN ELECTORSTATOGRAPHIC RECORDING MEDIUM

BACKGROUND OF THE INVENTION

1. Field of the Invention

This invention relates generally to the electrostatographic recording arts and more particularly to a method and apparatus of adjusting of charge level on an electrostatographic recording medium.

2. Description Relative to the Prior Art

In the prior art, it is well known in the electrostatographic recording arts to create multicolor toner images by forming two unfixed images on a single image frame of a photoconductive image member. Color printers have been marketed using this general approach using, for example, discharged area development (DAD) and electronic exposure by a raster output scanner (ROS) for each image. The advantage of exposing and developing the stone image frame for creating the two-color images is that the productivity of the copier and/or printer is enhanced since one image frame is used to record two-color images. In addition to improved productivity, image registration between the two-color images is easier to control and therefore more accurate than in a system where the colors are formed on separate image frames and then registered together when transferred to a record member such as plain paper or to an intermediate member and then to the record member. The recording of two-color images is generally known as highlight color or accent color imaging. In highlight color imaging, two different color developers are customarily employed, usually black and some other color; for example, red. The highlight or accent color may be selected from several available toning stations.

One approach to a single frame two-color image building is disclosed in commonly assigned U.S. application Ser. No. 08/645,989 filed on May 14, 1996 in the names of Hwai-Tzuu Tai and Richard G. Allen. In this electrophotographic process a mixture of discharged area development and charged area development (DAD and CAD) is employed using two ROS devices. In this process, the image member is charged to a relatively high surface voltage level using a primary charger, then an image area thereon is exposed using a first ROS device and then developed so that the first toner image is made using DAD. The image area is generally discharged using an electroluminescent light (EL) panel to an intermediate level or reduced voltage level. The image area is then background area exposed using the second ROS device and then developed with the second image made using CAD. The developed images are transferred to a receiver sheet and then fused to the sheet.

One problem associated with using such a process is that variability of the respective outputs of the primary charger and EL panel affects the quality of the image formed in either or both of the colors.

Another problem is that the best values for both the primary charge potential ($V_o$) and the intermediate potential ($V_o'$) may change substantially, owing to drifting characteristics of the two or more toners used. The exposure required from the EL panel is therefore highly variable.

The use of an EL panel to modify charge from a primary charger is also useful in a single color per image frame electrophotographic recording apparatus. As noted in U.S. Pat. No. 4,939,544 variations in output of the primary charger and EL panel are a known problem. In order to correct for variations in one or the other, a sensor may be placed to sense charge on a photoconductive member after exposure and such sensing is used to provide information for adjusting the outputs of either the primary charger or the EL panel. A problem with this approach is that since the sensor senses charge after the EL panel exposure a delay is provided in the creation of an image frame that is uniformly charged to the appropriate charge level. In addition, adjustments due to environmental conditions in primary charger output level can introduce delays in recording until appropriate charge levels for recording are obtained.

It is, therefore, an object of the invention to provide a recording apparatus and method featuring charging of an electrostatographic recording medium in a more efficient manner.

SUMMARY OF THE INVENTION

The above and other objects and advantages will become apparent from the description of the invention provided herein. In accordance with a first aspect of the invention, there is provided a method of producing images, comprising (a) depositing a primary electrostatic charge on an electrostatographic recording member; (b) sensing the level of the primary electrostatic charge; (c) enabling a light source to reduce the level of the primary electrostatic charge to provide a reduced voltage level suited for recording; (d) imagewise modulating the reduced voltage level on an image frame of the recording member; (e) developing the imagewise modulated image frame with toner; and (f) adjusting the output of the light source in response to a first factor related to the sensed level of the primary electrostatic charge and a set point value for the level of the reduced voltage level and a second factor related to error in the level of the reduced voltage level from the set point value for the reduced voltage level.

In accordance with a second aspect of the invention, there is provided for use in an electrostatographic recording apparatus having an electroluminescent light (EL) panel for reducing a primary electrostatic charge level to a reduced electrostatic charge level on an electrostatographic recording medium and a driver for providing current for driving the EL panel, a controller for controlling current and/or voltage generated by the driver, the controller comprising a look-up table memory having inputs of measured primary charge level and set point level for the reduced charge level and an output representing a coarse adjustment level for the driver; and a feedback circuit for generating a fine adjustment for said driver in response to a difference between a measurement of the reduced charge level and the set point for the reduced charge level.

In accordance with yet another aspect of the invention there is provided an apparatus for producing images, comprising primary charger means for depositing a primary electrostatic charge on the electrostatographic recording member; means for generating a signal relative to a sensed level of the primary electrostatic charge; means including a light source for reducing the level of the primary electrostatic charge to provide a reduced voltage level suited for recording; first exposure means for imagewise modulating the reduced voltage level on an image frame of the recording member; first development means for developing the imagewise modulated image frame with toner; and means for adjusting the output of the light source in response to a first factor related to a sensed level of the primary electrostatic charge and a set point value for the level of the reduced voltage level and a second factor related to error in the level of the reduced voltage level from the set point value for the reduced voltage level.

BRIEF DESCRIPTION OF THE DRAWINGS

In the detailed description of the preferred embodiments of the invention presented below, reference is made to the accompanying drawings in which:

FIGS. 2A–2F are illustrations of voltage levels on a photoconductive belt of the apparatus of FIG. 1 during various stages of forming a DAD-CAD image;

FIG. 5 is an example of data associated with a lookup table forming a part of the control elements of FIG. 3.

DETAILED DESCRIPTION OF THE PREFERRED EMBODIMENTS

Because electrostatographic reproduction apparatus are well known, the present description will be directed in particular to elements forming part of or cooperating more directly with the present invention. Apparatus not specifically shown or described herein are selectable from those known in the prior art. Specific preferred embodiments of the invention will be described with reference to electrophotographic recording apparatus although other types of electrostatographic apparatus may be used to advantage.

Figure 1:
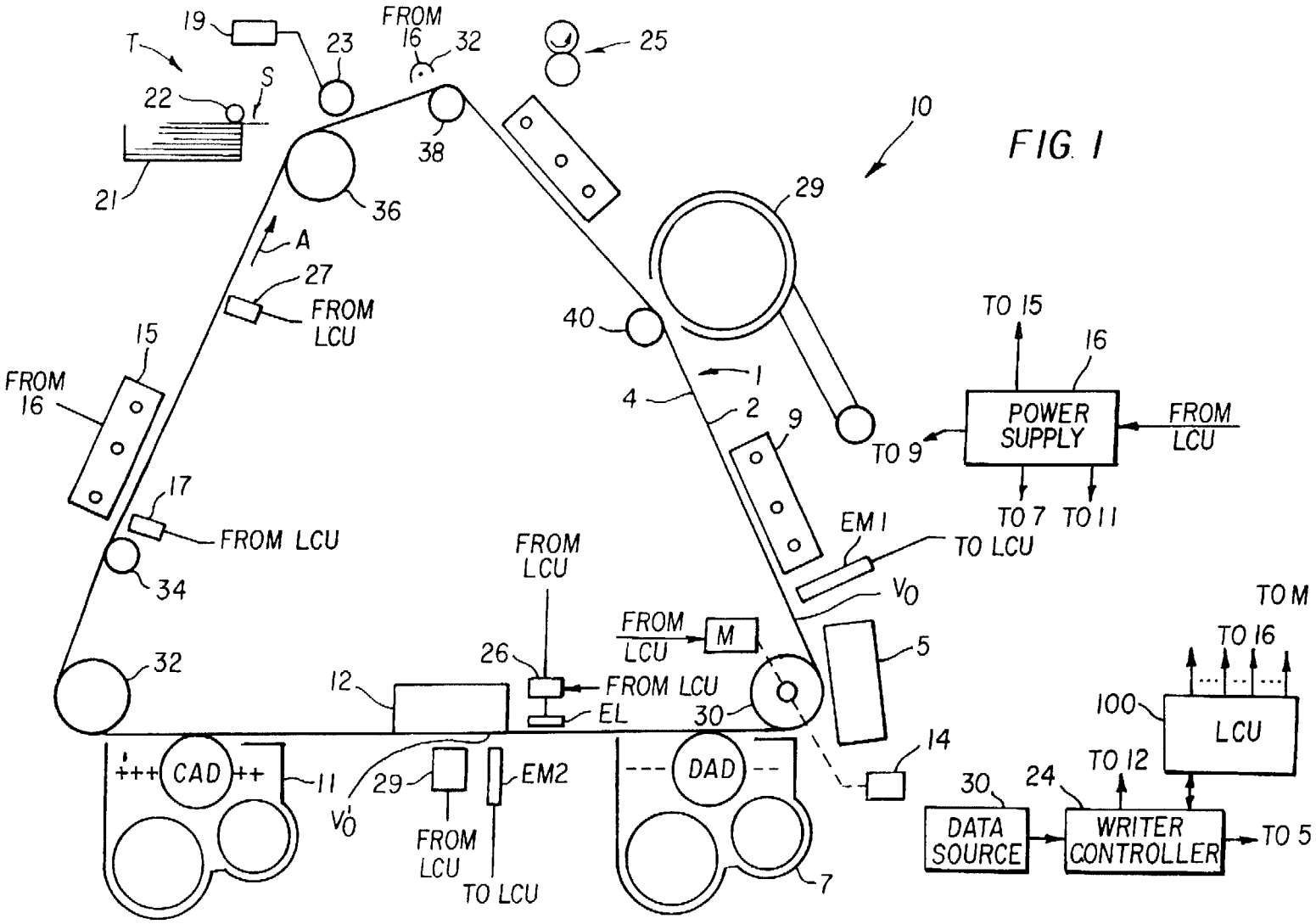
FIG. 1 is an elevation view in schematic of an electrophotographic marking engine forming a part of the invention.

FIG. 1 illustrates an electrophotographic recording apparatus 10 for forming a two-color toned image. According to FIG. 1, a moving image member 1 includes an image side 2 and an opposite or base side 4. In our preferred embodiment, the image member 1 is transparent. For example, it can be a belt or web image member having a polyester or other suitable transparent support well known and used in the art. Such image members include a transparent conductive layer on the image side 2 upon which is coated a suitable photoconductive layer(s) and an insulating layer to make the image member 1 photoconductive. The conductive layer and photoconductive layers are extremely thin and are not shown in the drawings. The image member 1 is driven in the direction shown by the arrow A by a motor M or other motive source that is coupled in a driving relationship to one or more rollers 30, 32, 34, 36, 38 and 40 about which the belt is entrained. The image member could also be a glass or transparent drum with similar layers coated thereon.

Operation of the apparatus is controlled by a logic and control unit (LCU) 100 which includes one or more microprocessors programmed as is well known in the art for providing signals in accordance with timed sequences controlled using one or more encoders 14 to selectively control operation of the various workstations described herein. Other stations not described may be provided as is known in the art. The operation of the apparatus will be described with respect to a negative charging image member. It will be clear to those skilled in the art, however, that a positive charging image member could also be used. Reference should also be had to FIGS. 2A through 2F which show in graphical form examples of charging effects in the various steps of the operation of the DAD/CAD apparatus of FIG. 1.

The image member is uniformly charged relative to ground to a negative potential (say –650 volts) by a first primary corona charger 9 (see FIG. 2A). Control of the charger 9 and the other chargers described herein may come from a programmable power supply 16. An image frame on the image member is imagewise exposed by a first ROS device 5 such as an LED or laser printhead to create a negative electrostatic latent image on the image frame (see FIG. 2B). The imagewise exposure(s) of the ROS devices are generated in response to signals from a writer controller 24 which in turn is connected to a data source 30 which may be a computer, word processor or other source of electronic information or an electronic scanner for scanning hard copy originals. At a DAD development station 7, a negative toner is applied to the image frame in the presence of an electric field which encourages deposition of the negative toner according to the amount of discharge of the electrostatic image. That is, the toner shown in FIG. 1 adheres to areas of lowest potential in the electrostatic image, creating a first toner image, as shown in FIG. 2C, created by a DAD process. In this example, the development station may be electrically biased to $V_b$=–550 volts. The development stations are preferably magnetic brush development stations.

The image frame is then exposed with light from a rear erase lamp to reduce the level of charge thereon to say –250 volts (see FIG. 2D) in areas not exposed to the first ROS device. A driver circuit 26 provides an AC supply of current to drive the erase lamp which is preferably an electroluminescent light (EL) panel. The same image frame is then exposed using a second ROS device 12 through its base 4 to create a second latent electrostatic image (FIG. 2E). The second ROS device also receives signals from a writer controller 24. It is preferred that this exposure be conducted through the base. However, the invention herein also contemplates that the second ROS exposure device 12 may be used at the same side as the first ROS exposure device.

The second electrostatic image on this image frame is then toned using a CAD toning process (FIG. 2F). More specifically, a magnetic brush 11 containing positive toner applies toner to image member 1 in the presence of an electric field that encourages deposition of toner on the high potential portions of the second electrostatic image. Typically, in CAD development, the electric field is biased by a suitable power supply, such as supply 16, providing a suitable electrical bias to the development station 11 so that a magnetic brush forming a part of this station is slightly more negative (V'b) than the exposed portions of the second electrostatic image to inhibit development of the non-image areas in the second electrostatic image. This electrical bias also inhibits pickup of negative toner from the first image.

Preferably, both toning stations 7 and 11 are constructed to provide a soft magnetic brush having a tendency to cause little disturbance to the first toner image and providing extremely high density at high speed with a relatively small station.

If the colors of the toners in toning stations 7 and 11 are of different color, image member 1 now has a two color image. Obviously, the toners in stations 7 and 11 could be of the same color but different characteristics. For example, one of the two toners could be a black magnetic toner and the other a black non-magnetic toner, which arrangement would have certain advantages in certain processes such as printing of checks. For purposes herein, such a combination of non-magnetic and magnetic black toners is essentially the same as a two-color toner image. Similarly, one toner may have color and the other toner may be colorless. Thus, the term "colors" as used herein is not limited to different visible colors but includes other printed combinations as those just described.

The two-color image is made up of toners of both negative and positive polarity owing to having been developed by DAD and CAD processes, respectively. The two-color toner image proceeds to a pretransfer treatment station made up of a corona charger 15 and erase lamps 17 and 27. Corona charger 15 is biased to change the polarity of one of the toners making up the two color toner image. For example, it may apply a negative charge to the two color image, thereby changing the polarity on the positive toner particles applied at toning station 11 to a negative polarity. As is well known in the art, this process can be assisted by use of erase lamps 17 and 27 positioned at or before the corona charger 15 which reduces the surface potential applied to the non-image areas while encouraging sufficient charge to deposit on the toner intended to be charged. A second erase lamp 27 is provided to also remove fields within the PC to facilitate transfer.

The treated two-color image proceeds to the transfer station T. The transfer station includes a transfer backing roller 23, where a potential is applied from a reversible potential source 19, encouraging transfer of the toner to a receiver sheet, S, fed from a receiver sheet supply or stack 21.

At the transfer station T, a sheet S of support material is moved into contact with the toner images on the image frame. The sheet of support material is advanced to the transfer station by conventional sheet feeding apparatus, not shown. Preferably, the sheet feeding apparatus includes one or more feed rolls 22 contacting the uppermost sheet of a stack 21 of copy sheets. The feed rolls rotate so as to advance the uppermost sheet from the stack into a chute or guide which directs the advancing sheet of support material into contact with the photoconductive surface of belt 1 in a timed sequence so that the toner powder image developed thereon contacts the advancing sheet of support material at transfer station T. After transfer of the image to the sheet S, the sheet is detacked from the belt 1 with the assistance of charge from a detack charger 32 and fed into the nip of a pair of fusing rollers 25 that are heated to fuse the toned images to the sheet.

With reference again now to FIG. 2A, there is illustrated the film potential $V_o$ after primary corona charge is provided by corona charger 9. Note that typically the applied charge may be slightly higher than the illustrated −650 volts relative to ground due to dark discharge as is well known. In FIG. 2B, there is illustrated the effect on this primary charge of a $D_{MAX}$ exposure by exposure device 5. The potential in the exposed area is reduced substantially say to about −100 volts. With the bias on development station, $V_b$, set at about −550 volts the exposed image area is developed with a first colored toner, say black (FIG. 2C). Note that a $D_{MAX}$ exposure is not required but that the exposure may be made that reduces the charge level below that of $V_b$; i.e., closer to ground. The ROS devices are preferably both grey level exposure devices. Thus, exposure from these devices can provide, in accordance with gray level image data, varying levels of exposure for each pixel to generate different tonal qualities to the image. In FIG. 2B, the exposed pixel areas can be exposed to varying levels in accordance with the gray level image data but each of such exposures should reduce the respective area to below that of $V_b$. In FIG. 2D, light from a rear erase lamp, preferably an EL panel, 6 has exposed the image frame to reduce potential in the ROS unexposed areas to a potential of $V_o'$=−250 volts relative to ground. Since the erase is from the rear, the level of charge of the black toned image area is also reduced. The bias, $V'_b$, of development station 11 is controlled to be about −100 volts. With reference to FIG. 2E, an imagewise exposure from ROS exposure device 12 reduces the level of charge in the exposed area to between ground and $V'_b$. The areas exposed by exposure device 12 to below $V'_b$ are areas of the image frame where toner from development station 11 is not to be deposited. Thus, the areas exposed by the second ROS device 12 includes areas beneath the first toned image as well as areas that are not to be developed at all. Areas left unexposed are developed with a positively charged toner from development station 11 which say is red (R). Alternatively, the second ROS device 12 need not expose areas beneath the first developed image and just expose those areas that are not to be developed in red. In order to provide for gray level rendering of the red and black developed areas, the ROS devices 5 and 12 may each have the capability to generate exposures at different intensity levels or exposure durations to expose pixels which will develop in different densities. However, the available level for creation of the black pixels in this example will vary from exposures that cause decrease in $V_o$ to a range between about −100 volts and about −500 volts. The available levels for creation of the red pixels in this example will vary from a range that includes exposures that cause exposed pixel areas to be about −150 volts to no exposure with $V'_o$ being about −250. As may be seen in FIG. 2F, development has occurred in the areas having a voltage potential greater than $V_b'$. A format and interframe erase light source 29 is provided opposite the ROS device 12 to prevent development of areas outside the image frame by the CAD development unit.

As noted above, a problem associated with operation of the apparatus and process illustrated in FIGS. 1 and 2 is that to obtain consistent formation of quality images, variability in the charge level $V_o$ needs to be reduced for the black or DAD image. Furthermore, because of variability in sensitivity of the black and color toning processes both $V_o$ (for black) and $V'_o$ (for color) need adjustment independently to provide stable tone scales. The required intensity of the EL panel is highly dependent on both the $V_o$ voltage entering beneath the EL panel and the desired exit $V'_o$ required.

A need has developed, therefore, for a fast and accurate automatic adjustment of the EL panel intensity, wherein the EL panel is able to respond promptly to coarse changes in measured $V_o$ $V'_o$ set point which may be changed in view of changes in environmental factors, or the replacement of one highlight color station with another.

Figure 3:
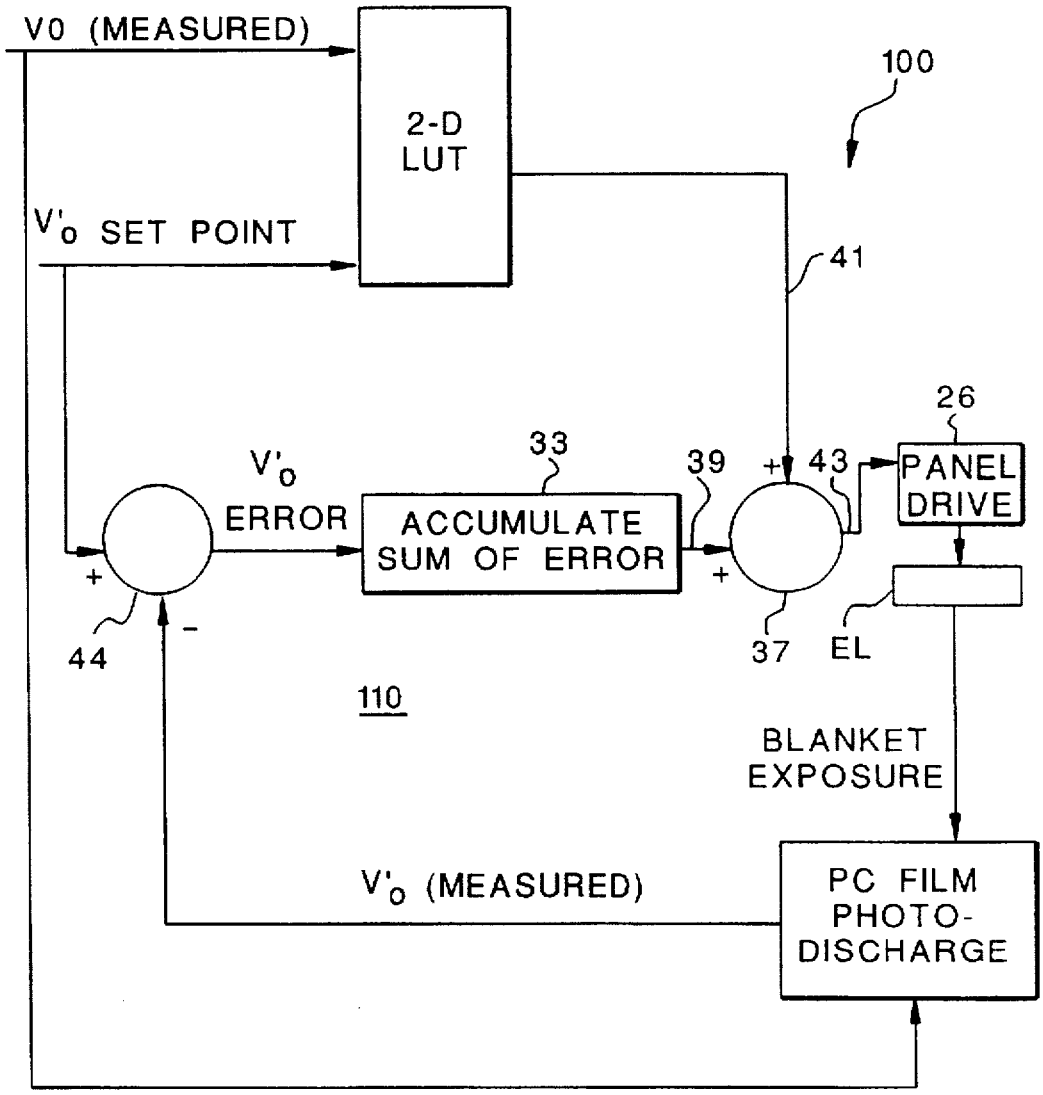
FIG. 3 is a block diagram in schematic form of the measurement and control elements in accordance with the invention for controlling a charge level on a recording medium forming a part of the apparatus of FIG. 1.

The method and apparatus of the invention features a control circuit 100 that includes a 2-dimensional lookup table (LUT) and a feedback control loop 110 as shown in FIG. 3. The 2-D LUT contains the empirically predetermined coarse values for the EL panel drive 26 according to the measured $V_o$ as sensed by electrometer EM1 and the desired or set point for $V'_o$ which is determined empirically to be, say −250 volts. To compensate for LUT inaccuracy or drift in the required value for the EL panel control voltage from the coarse values of the LUT, the LUT output is modified by the output of the feedback control loop 110, whose output on line 39 of accumulator 33 is proportional to the integral or accumulated sum of the error between the set point $V_o'$ and the actual $V_o'$ as measured by an electrometer (EM2). Measurement of EM2 may be made by sensing levels of $V_o'$ in interframe areas or within a portion of an image frame that has not been exposed by ROS devices. The modification may be accomplished in one of several ways such as adding using an adder 37 to add the scaled feedback controller output on line 39 to the LUT output on line 41 (as shown in FIG. 3) or (b) adding the scaled feedback controller output to a multiplying factor (nominally 1.000) which then multiplies the LUT output. In both ways, the adjustments are iteratively updated using $V_o'$ and $V_o$ measurements and changes made to the control setting to the drive circuit 26 for the EL panel until the error in $V'_o$ is sufficiently small. In FIG. 3, the sum of the LUT output and the control loop output is provided on line 43 and is thereby adjusted iteratively driving the measured $V_o'$ closer to the $V_o'$ set point with each iteration through adjustment of the EL panels drive circuit voltage and/or current driving parameters. By this means, the 2-D LUT provides an immediate response to any change in measured Vo or desired or set point $V_o'$. The feedback loop thus compensates for inaccuracy in the LUT values and drift in the characteristics of the photoconductive film (PC) and drift in the EL panel and its associated circuitry.

In the context of the DAD/CAD approach for full productivity accent color, it is desired to make adjustments automatically without pausing for setup procedures. Furthermore, the EL panel exposure must take into account a highly variable entry PC voltage ($V_o$) as well as a variable desired PC voltage ($V_o'$) after the EL panel exposure. With the apparatus and method of the invention, coarse adjustment in response to changing $V_o$ and/or desired $V_o'$ is provided by the LUT without delay, since no $V_o'$ measurement input is required by the LUT.

With reference to FIG. 5, values for the 2-D LUT are empiric ally predetermined during a factory calibration for the particular type of PC. The input values $V_o$ (measured) and $V_o'$ setpoint are calibrated vis-a-vis EL panel setting values. The setting values will cause the drive circuit 26 associated with the EL panel to adjust AC pulse amplitude and pulse frequency to the EL panel drive to adjust EL panel light outputs. Typical values provided are illustrated in the chart of FIG. 5 for an exemplary EL panel and drive circuit from the KODAK COLOREDGE Color Copier made by Eastman Kodak Company, Rochester, N.Y. If the LUT has only a few rows and columns, good accuracy of the LUT output requires interpolation when $V_o$ (measured) and $V_o'$ set point values are intermediate between the values of the LUT.

The apparatus of FIG. 1, requires an electrometer EM2 be positioned downstream from the EL panel, but before the color toning station and preferably before the color writer. The same electrometer could also be used for intermittent $V_o$ measurement (ignoring dark decay) by briefly turning off the EL panel.

Figure 4:
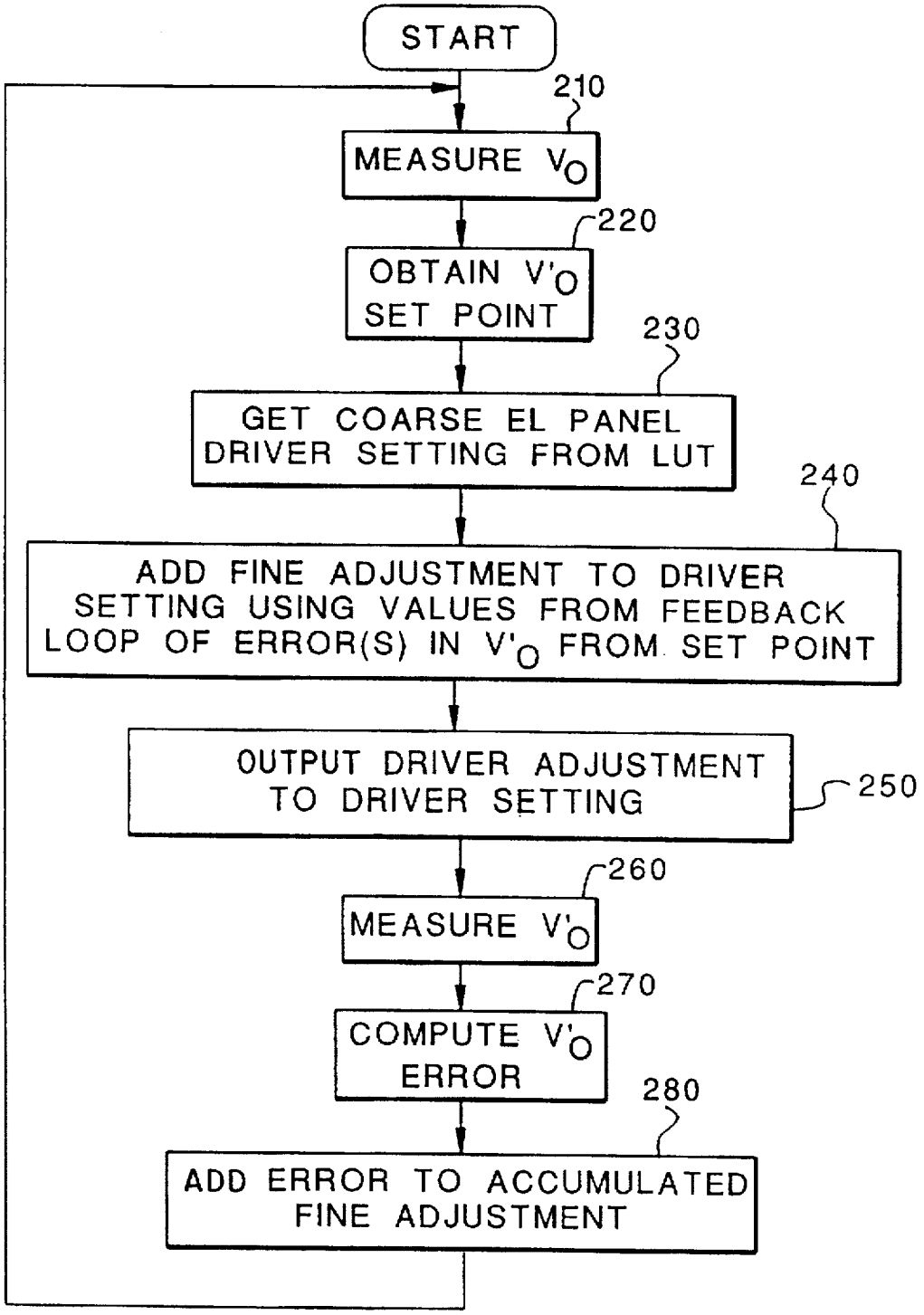
FIG. 4 is a flowchart illustrating operation of the method of the invention.

Reference will now to had to the flowchart of FIG. 4 to illustrate operation of the method of the invention. In conjunction with the embodiment of FIG. 1 assume that the apparatus of FIG. 1 is warmed up and otherwise operative for making prints. In step 210, electrometer EM1 measures $V_o$ on the photoconductive web (PC) as established by primary charger and prior to exposure by the first ROS device 5. The $V_o'$ set point is then obtained, step 220. The $V_o'$ set point is either a factory calibrated setting or field set value that is stored in the LCU's memory. The two values are then input into the 2-D LUT to obtain a coarse panel setting, step 230. The output from the LUT also may be interpolated as noted above. The coarse EL panel setting value is added to an accumulated fine adjustment setting value from the feedback loop 110, step 240. Note that there is no accumulated fine adjustment in the first iteration. The sum of the coarse and fine adjustment setting values are input to the EL panel drive circuit 26 to change the voltage and/or current to the EL panel and thus the light output by the EL panel for the current image frame which is about to pass beneath the EL panel and which may have been previously developed with the black toner, step 250. Output of the EL panel will be maintained the same for an entire image frame to provide uniformity in charge level of unexposed areas.

After exposure by the EL panel, the output level $V_o'$ which is the charge level on the PC after knock-down from Vo by the EL panel is sensed by electrometer EM2 and measured by the LCU. The value $V_o'$ is then fed back as negative feedback to adder 44 where it is summed with the predetermined set point value $V_o'$ stored in the LCU to generate an error signal for $V_o'$, step 270. These errors are accumulated and output to adder 37 where they are used to provide a fine adjustment or offset to the coarse setting output of the LUT as noted above, step 280. It will be understood that the feedback circuit and LUT of FIG. 3 may largely be implemented in software using the inputs measured by the various sensors and performed by a computer or by a hardwired device. In either case, signals are generated that are operated on by the various components of the computer or the hardwired device.

The invention thus provides an improved means and method for controlling output of an EL panel. Coarse output of the EL panel is provided based on both measured Vo and the set point for $V_o'$. Thus, changes in $V_o$, whether due to desired changes because of environmental conditions or to drift by the primary charger are a factor in affecting EL panel output. Such is desirable because the EL panel output is provided to knockdown levels of $V_o$. Thus, values of $V_o'$ are now reasonably related to $V_o$ on the same image frame as they should be even where $V_o$ is subject to drift. Fine adjustment of EL panel output is accommodated by its own feedback loop, thus compensating for drift in the EL panel output. Thus, improved control is provided in removing undesired variability in image quality.

The invention is applicable to other embodiments such as noted above image reproduction apparatus wherein only one development station is operative on each image frame and the EL panel is used to trim the primary charge level.

The invention has been described in detail with particular reference to preferred embodiments thereof, but it will be understood that variations and modifications can be effected within the spirit and scope of the invention as described hereinabove and as defined in the appended claims.

I claim:

1. A method of producing images, comprising:

(a) depositing a primary electrostatic charge on an electrostatographic recording member;

(b) sensing the level of the primary electrostatic charge;

(c) enabling a light source to reduce the level of the primary electrostatic charge to provide a reduced voltage level suited for recording;

(d) imagewise modulating the reduced voltage level on an image frame of the recording member;

(e) developing the imagewise modulated image frame with toner; and (f) adjusting the output of the light source in response to a first factor related to the sensed level of the primary electrostatic charge and a set point value for the level of the reduced voltage level and a second factor related to error in the level of the reduced voltage level from the set point value for the reduced voltage level.

2. The method of claim 1 wherein the image frame is also imagewise modulated by a first ROS device and developed with a first toner at a first development station after step (a)

but before step (c) and the image frame is imagewise modulated in step (d) by a second ROS device and developed in step (e) by a second development station.

3. The method of claim 2 wherein the first development station develops an image on the image frame in accordance with a DAD process and the second development station develops an image in accordance with a CAD process.

4. The method of claim 3 wherein the first factor is generated as an output of a look-up table and is added to the second factor.

5. The method of claim 4 wherein the second factor is an accumulated sum of errors of sensed reduced voltage levels with respect to a set point for the reduced voltage level.

6. The method of claim 1 wherein the first factor is generated as an output of a look-up table and is added to the second factor.

7. The method of claim 6 wherein the second factor is an accumulated sum of errors of sensed reduced voltage levels with respect to a set point for the reduced voltage level.

8. For use in an electrostatographic recording apparatus having an electroluminescent light (EL) panel for reducing a primary electrostatic charge level to a reduced electrostatic charge level on an electrostatographic recording medium and a driver for providing current for driving the EL panel, a controller for controlling current and/or voltage generated by the driver, the controller comprising:

a look-up table memory having inputs of measured primary charge level and set point level for the reduced charge level and an output representing a coarse adjustment level for the driver; and a feedback circuit for generating a fine adjustment for said driver in response to a difference between a measurement of the reduced charge level and the set point for the reduced charge level.

9. An apparatus for producing images, comprising:

primary charger means for depositing a primary electrostatic charge on the electrostatographic recording member;

means for generating a signal relative to a sensed level of the primary electrostatic charge;

means including a light source for reducing the level of the primary electrostatic charge to provide a reduced voltage level suited for recording;

first exposure means for imagewise modulating the reduced voltage level on an image frame of the recording member;

first development means for developing the imagewise modulated image frame with toner; and means for adjusting the output of the light source in response to a first factor related to a sensed level of the primary electrostatic charge and a set point value for the level of the reduced voltage level and a second factor related to error in the level of the reduced voltage level from the set point value for the reduced voltage level.

10. The apparatus of claim 9 and second exposure means for imagewise modulating the primary electrostatic charge on the image frame to form a first latent image;

second development means for developing the first latent image with toner; and wherein the second exposure means and second development means operate on the image frame prior to the first exposure means and first development means.

11. The apparatus of claim 10 wherein the second development station develops an image on the image frame in accordance with a DAD process and the first development station develops an image in accordance with a CAD process.

12. The apparatus of claim 11 including a look-up table and wherein the first factor is generated as an output of the look-up table and is added to the second factor.

13. The apparatus of claim 12 wherein the second factor is an accumulated sum of errors of sensed reduced voltage levels with respect to a set point for the reduced voltage level.

14. The apparatus of claim 9 including a look-up table and wherein the first factor is generated as an output of a look-up table and is added to the second factor.

15. The apparatus of claim 14 wherein the second factor is an accumulated sum of errors of sensed reduced voltage levels with respect to a set point for the reduced voltage level.

* * * * *